US006762545B2

(12) United States Patent
Choe et al.

(10) Patent No.: US 6,762,545 B2
(45) Date of Patent: Jul. 13, 2004

(54) TENSION MASK FOR COLOR CRT, METHOD FOR MANUFACTURING THE TENSION MASK, AND EXPOSURE MASK USED IN THE MANUFACTURE OF THE TENSION MASK

(75) Inventors: Deok-Hyeon Choe, Suwon (KR); Jong-Han Rhee, Suwon (KR); Sang-Ho Jeon, Suwon (KR); Young-Bin Im, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 348 days.

(21) Appl. No.: 09/836,550

(22) Filed: Apr. 18, 2001

(65) Prior Publication Data

US 2001/0050524 A1 Dec. 13, 2001

(30) Foreign Application Priority Data

Apr. 20, 2000 (KR) ..... 2000-20994

(51) Int. Cl.[7] ..... H01J 29/07
(52) U.S. Cl. ..... 313/403
(58) Field of Search ..... 313/402–408

(56) References Cited

U.S. PATENT DOCUMENTS 3,883,770 A * 5/1975 Yamada et al. ..... 313/403
4,926,089 A 5/1990 Moore ..... 313/403
4,942,332 A 7/1990 Adler et al. ..... 313/402
5,856,725 A * 1/1999 Ueda ..... 313/402
6,545,402 B1 * 4/2003 Ko ..... 313/403

* cited by examiner

*Primary Examiner*—Ashok Patel
(74) *Attorney, Agent, or Firm*—Robert E. Bushnell

(57) ABSTRACT

A tension mask for a color cathode-ray tube, a method for manufacturing the tension mask, and an exposure mask for use in the manufacture of the tension mask are provided. The tension mask is manufactured by depositing photosensitive layers over the top and bottom surfaces of a steel foil. An upper exposure mask with a pattern including a series of parallel upper light transmission portions arranged in lines is aligned over the top surface of the steel foil, and a lower exposure mask with a pattern is aligned over the bottom surface of the steel foil. Here, the pattern of the lower exposure mask includes a series of parallel lower light transmission portions arranged in lines, a plurality of first light shielding portions intersecting adjacent lower light transmission portions among the series of the parallel lower light transmission portions, and a plurality of second light shielding portions partially extending between the edges of the adjacent lower light transmission portions. Following this, the photosensitive layers uncovered with the lower and upper exposure masks are exposed using an exposure light source, and then the upper and lower exposure masks are removed from the steel foil and developing the photosensitive layers remaining on the steel foil. Lastly, the steel foil which has undergone the developing process is etched, so that the tension mask is completed.

24 Claims, 13 Drawing Sheets

TENSION MASK FOR COLOR CRT, METHOD FOR MANUFACTURING THE TENSION MASK, AND EXPOSURE MASK USED IN THE MANUFACTURE OF THE TENSION MASK

CLAIM OF PRIORITY

This application makes reference to, incorporates the same herein, and claims all benefits accruing under 35 U.S.C. §119 from an application entitled Tension Mask for Color Picture Tube and Method of Manufacturing the Same and Exposure Mask for Making the Tension Mask earlier filed in the Korean Industrial Property Office on Apr. 20, 2000, and there duly assigned Serial No. 20994/2000 by that Office.

BACKGROUND OF THE INVENTION

1. Field of the Invention

The present invention relates to a color cathode-ray tube (CRT), and more particularly, to a tension mask having a color selection function, which is secured into the panel of a cathode-ray tube, a method for manufacturing the tension mask, and an exposure mask for use in the manufacture of the tension mask.

2. Description of the Background Art

In color cathode-ray tubes for television and computer displays, three electron beams emitted from an electron gun land onto a phosphor screen installed on the inner side of a panel through apertures of a mask having a color selection function, to excite red, green, and blue phosphors deposited on the phosphor screen, thereby forming images.

In a color cathode-ray tube, which forms images with the above-mentioned structure, the mask having a color selection function includes a dot mask for computer monitors, and a slot mask (or slit mask) for televisions. The dot mask and the slot mask are designed to have a predetermined curvature corresponding to a curvature of the phosphor screen, which has been curved taking into account a deflection trajectory of electron beams onto the phosphor screen.

Such masks are made of steel foil having a thickness of 0.1–0.25 mm (millimeters). A plurality of apertures are formed in the steel foil via etching, and then the steel foil is molded to have a predetermined curvature. If the curvature of the mask is less than a predetermined level, the mask is readily subjected to a permanent thermal distortion. As a result, the mask cannot perform its intrinsic color selection function. There is an increasing need for flat cathode-ray tubes. However, there are limitations in the manufacturing of flat cathode-ray tubes having the above-mentioned configuration.

A slot mask suitable for flat cathode-ray tubes, which is free from doming caused by thermal expansion, is disclosed in U.S. Pat. No. 4,942,332 issued to Adler et al. for Tied Slit Mask for Color Cathode Ray Tube. The slit-type foil tension mask includes a series of parallel strips separated by slits. The strips are loosely coupled by widely spaced ties.

Another mask, which is disclosed in U.S. Pat. No. 4,926,089 issued to Moore for Tied Slit Foil Shadow Mask with False Ties includes a plurality of tie bars interconnecting adjacent strips and to define slots, and a plurality of false bars extending between the adjacent strips to face each other, but not interconnecting the adjacent strips.

In general, such a tension mask having the above configuration is manufactured by photolithography. In particular, a photosensitive layer is deposited over both sides of a steel foil, exposed to an exposure light using an exposure mask to form a predetermined pattern, and then etched, so that a complete mask is obtained.

For the tension mask formed by the earlier techniques, the width of the slot between the adjacent strips at the electron beam emitting surface of the mask, is larger than the width of the slot at the electron beam entering side of the mask. An etching boundary, where etching from the upper and lower sides of the steel foil stops, is located close to the bottom surface of the resultant tension mask. That is, the distance from the top surface of the strip to the etching boundary is larger than the distance from the bottom surface of the strip to the etching boundary. As a result, the incident angle of electron beams passing the slot is small, so that the amount of beam passing through the slot decreases.

On the other hand, because the gap between the adjacent upper second light shielding portions of the upper exposure mask is equal to that between the adjacent lower second light shielding portions of the lower exposure mask, etching boundaries for the false bars of the tension mask, which extend from the adjacent strips, is located at a position separated by the same distance from the top and bottom of the strips. Unfortunately, the etching boundaries located in the middle of each false bar cause clogging of the gap between the adjacent false bars in the manufacture of the mask. In addition, if the gap between the false bars is widened so as to prevent clogging of the gap, a problem of false bar visibility occurs when the mask is adopted in a cathode-ray tube.

On the other hand, the gap between the false bars is limited by the thickness of the steel foil used. Earlier etching techniques applied in the manufacture of masks is insufficient to form a mask having a fine pattern, which is not shown on the screen when the mask is secured into the panel of a cathode-ray tube. In particular, although a steel foil which is thin ensures a smaller gap between adjacent false bars, the use of the thin steel foil increases the manufacturing costs, and lowers strength of the mask.

SUMMARY OF THE INVENTION

It is therefore an objective of the present invention to provide a tension mask for a color cathode-ray tube (CRT), in which variations in gaps between facing dummy bridges are reduced by adjusting the shape and thickness of real bridges and dummy bridges of the tension mask, thereby preventing the problem of bridge visibility.

It is another objective to provide a method for manufacturing a tension mask for a color cathode-ray tube, in which a desired pattern of the tension mask including slots, real bridges and dummy bridges can be obtained irrespective of the thickness of a steel foil selected to form the tension mask.

It is yet another objective to provide an exposure mask for use in manufacturing the tension mask.

Accordingly, to achieve the above objectives, there is provided a tension mask for a color cathode-ray tube including a series of parallel strips separated by a predetermined distance from each other, a plurality of real bridges intersecting adjacent strips among the series of parallel strips to define slots through which electron beams pass, and a plurality of dummy bridges located in the slots, partially extending between but not intersecting the adjacent strips, facing each other, where an etching boundary of each of the dummy bridges is located below the middle of the strips.

It is preferable that the plurality of real bridges are recessed by a predetermined depth from the top surface thereof The distance from the bottom of the strips to the etching boundaries of the dummy bridges may be 0.25 times smaller than the thickness of the strips. It is preferable that the thickness of each of the real bridges at the recessed center thereof is approximately the same as the distance from the bottom of the strips to the etching boundaries of the dummy bridges.

In another embodiment of the present invention, a tension mask for a color cathode-ray tube includes a series of parallel strips separated by a predetermined distance from each other, a plurality of real bridges intersecting adjacent strips among the series of the parallel strips to define slots through which electron beams pass, and a plurality of dummy bridges located in the slots, partially extending between but not intersecting the adjacent strips, facing each other, where an etching boundary of each of the dummy bridges is located below the middle of the strips, the tension mask including a pair of first rounded portions formed with a first thickness at the beam emitting side of each of the slots, partially extending from the adjacent strips, and a pair of second rounded portions formed with a second width at the beam entering side of each of the slots, partially extending from the adjacent strips.

A method for manufacturing a tension mask for a color cathode-ray tube (CRT) includes depositing photosensitive layers over the top and bottom surfaces of a steel foil, aligning an upper exposure mask with a pattern including a series of parallel upper light transmission portions arranged in lines over the top surface of the steel foil, aligning a lower exposure mask with a pattern over the bottom surface of the steel foil, the pattern of the lower exposure mask including a series of parallel lower light transmission portions arranged in lines, a plurality of first light shielding portions intersecting adjacent lower light transmission portions among the series of the parallel lower light transmission portions, and a plurality of second light shielding portions partially extending between the edges of the adjacent lower light transmission portions, exposing the photosensitive layers uncovered with the lower and upper exposure masks using an exposure light source, removing the upper and lower exposure masks from the steel foil and developing the photosensitive layers remaining on the steel foil, and etching the steel foil which has undergone the developing process.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
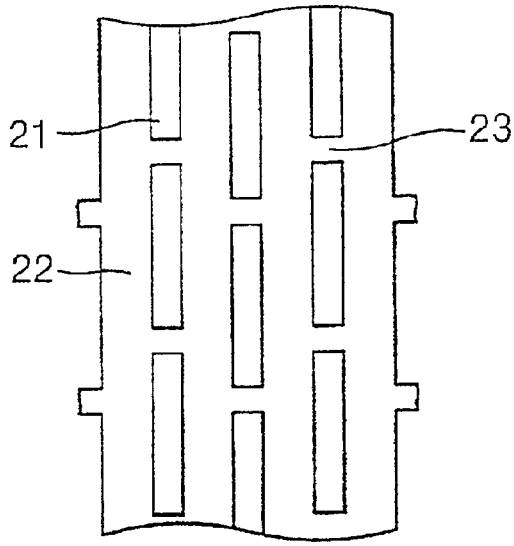
FIG. 1 (PRIOR ART)
FIG. 1 is a plan view of a conventional mask for a cathode-ray tube (CRT)
Figure 2:
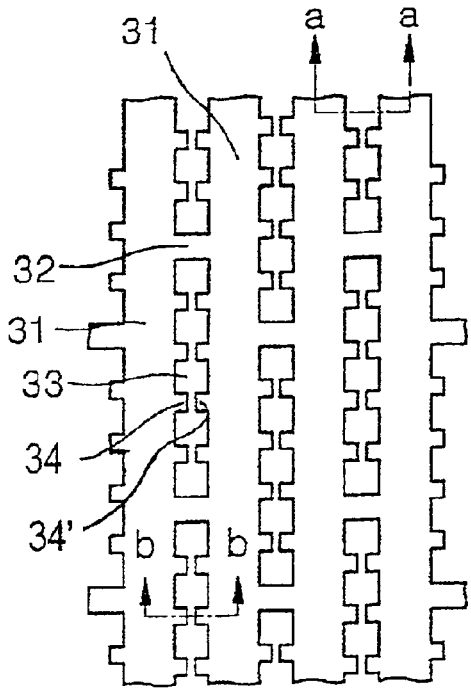
FIG. 2 is a plan view of another mask for a cathode-ray tube.

Turning now to the drawings, as shown in FIG. 1, disclosed by U.S. Pat. No. 4,942,332 issued to Adler et al. for Tied Slit Mask for Color Cathode Ray Tube, the mask includes a series of parallel strips 22 separated from each other by a predetermined distance, and a plurality of tie bars 23 interconnecting the adjacent strips to define the slots 21 at predetermined intervals. Referring to FIG. 2, another mask is constituted to include a plurality of tie bars 32 interconnecting adjacent strips 31 and 31' to define slots 33, and a plurality of false bars 34 extending between the adjacent strips 31 and 31' to face each other, but not interconnecting the adjacent strips 31 and 31'.

In general, such a tension mask having the above configuration is manufactured by photolithography. In particular, a photosensitive layer is deposited over both sides of a steel foil, exposed to an exposure light using an exposure mask to form a predetermined pattern, and then etched, so that a complete mask is obtained. An earlier method of manufacturing a mask will be described in greater detail with reference to FIGS. 3A through 3C.

Figure 3A:
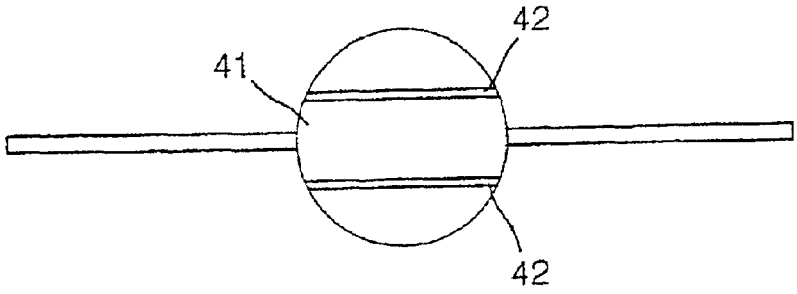
FIGS. 3A through 3C illustrate an earlier method for manufacturing a mask.
Figure 3B:
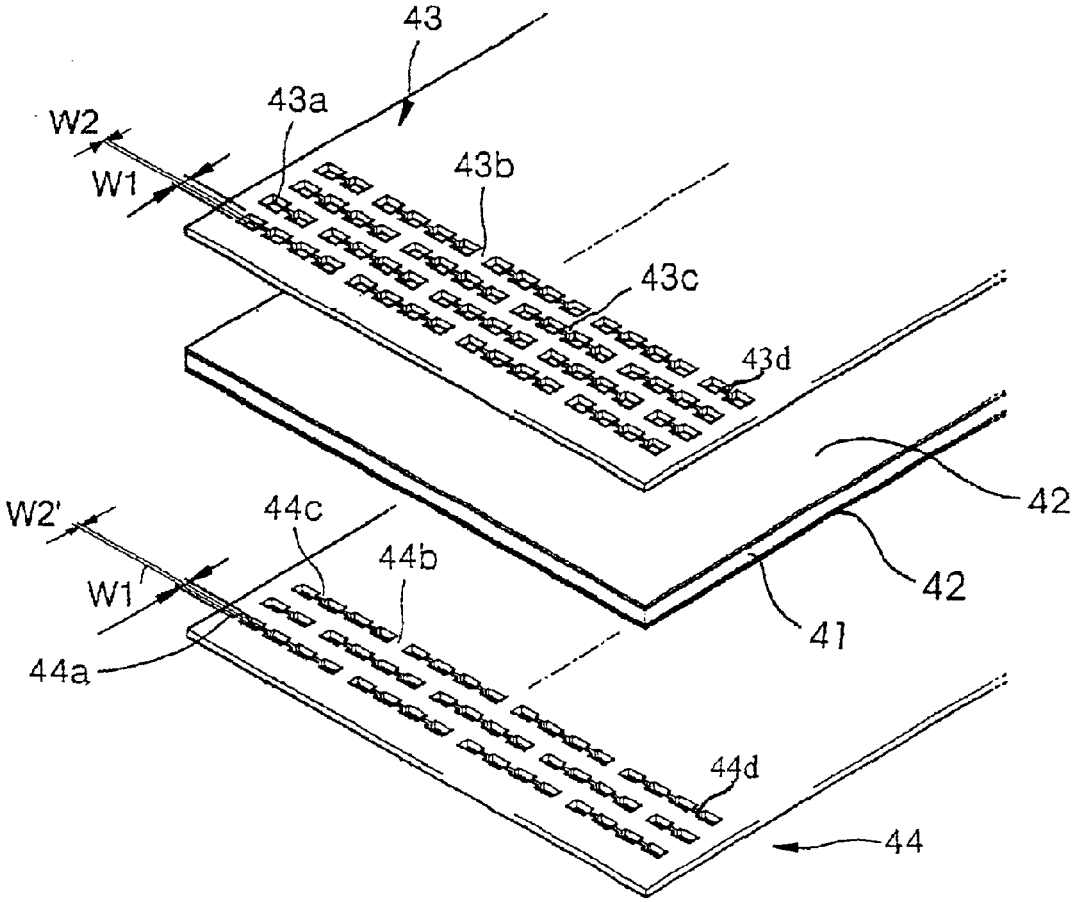

Referring to FIG. 3A, photosensitive layers 42 are coated over both sides of a steel foil 41. Following this, an upper exposure mask 43 and a lower exposure mask 44, which have a predetermined pattern, are put on both sides of the steel foil 41 having the photoresist layers 42, and irradiated with light (not shown), as shown in FIG. 3B. Here, the upper exposure mask 43 has a similar pattern to that of the mask described above. That is, the upper exposure mask 43 has a series of parallel upper light transmission slots 43*a*, which are completely or partially intersected by a plurality of upper first light shielding portions 43*b*, which correspond to tie bars of a mask to be formed, intersecting the upper light transmitting slots 43*a*, and a plurality of upper second light shielding portions 43*c*, which correspond to false tie bars of the mask. The lower exposure mask 44 has a series of parallel lower light transmission slots 44*a* whose width W1' is smaller than the width W1 of the upper light transmission slots 43*a*, which are partitioned by a plurality of lower first and second light shielding portions 44*b* and 44*c*. The upper exposure mask 43 has a horizontal width W2 of the dummy slit 43*d* and the lower exposure mask 44 has a horizontal width W2' of the dummy slit 44*d*.

Figure 3C:
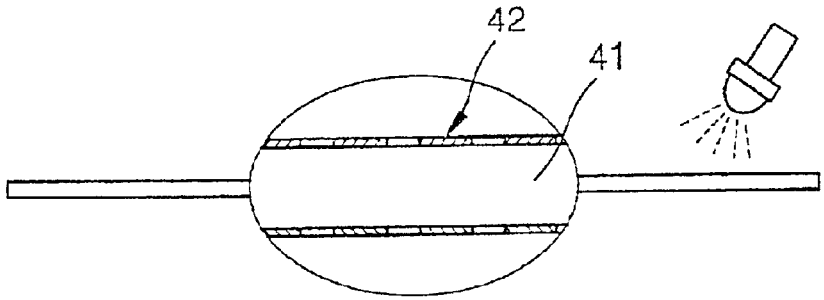

The exposure masks having the above pattern are applied on the photosensitive layers 42 formed over the steel foil 41, and exposed to light. After the exposure, as shown in FIG. 3C, the resultant structure is developed, etched, and then spray-cleaned with a high-pressure cleaning solution 46, thereby resulting in a complete tension mask.

Figure 4:
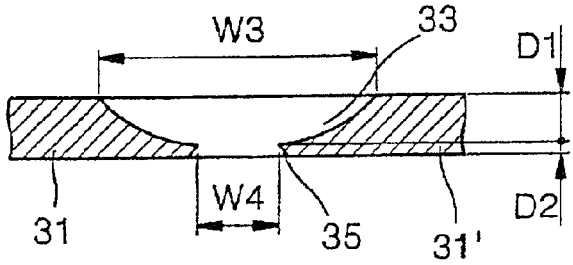
FIG. 4 is a sectional view taken along line a—a of FIG. 2.

For the tension mask formed by the earlier technique, as seen in FIG. 4, the width W3 of the slot 33 between the adjacent strips 31 and 31' at the electron beam emitting surface of the mask, is larger than the width W4 of the slot 33 at the electron beam entering side of the mask. An etching boundary 35, where etching from the upper and lower sides of the steel foil stops, is located close to the bottom surface of the resultant tension mask. That is, the distance D1 from the top surface of the strip 31 or 31' to the etching boundary 35 is larger than the distance D2 from the bottom surface of the strip 31 or 31' to the etching boundary 35. As a result, the incident angle of electron beams passing the slot 33 is small, so that the amount of beam passing through the slot 33 decreases.

Figure 5:
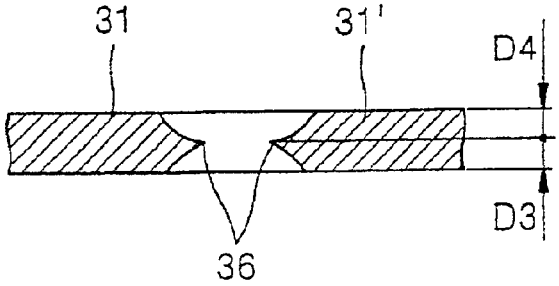
FIG. 5 is a sectional view taken along line b—b of FIG. 2.

On the other hand, because the gap between the adjacent upper second light shielding portions 43*c* of the upper exposure mask is equal to that between the adjacent lower second light shielding portions 44*c* of the lower exposure mask, as shown in FIG. 5, etching boundaries 36 for the false bars 34 and 34' of the tension mask, which extend from the adjacent strips 31 and 31', is located at a position separated by the same distance from the top (D4) and bottom (D3) of the strips 31 and 31'. Unfortunately, the etching boundaries 36 located in the middle of each false bar cause clogging of the gap between the adjacent false bars 34 and 34' in the manufacture of the mask. In addition, if the gap between the false bars 34 and 34' is widened so as to prevent clogging of the gap, a problem of false bar visibility occurs when the mask is adopted in a cathode-ray tube.

On the other hand, the gap between the false bars is limited by the thickness of the steel foil used. For example, if the thickness of the steel coil is 0.10 millimeters, the adjacent false bars produced by etching have a gap of 0.05–0.07 millimeters. If the thickness of the steel coil is 0.05 millimeters, the adjacent false bars produced by etching have a gap of 0.03–0.04 millimeters. The above mentioned etching technique applied in the manufacture of masks is insufficient to form a mask having a fine pattern, which is not shown on the screen when the mask is secured into the panel of a cathode-ray tube. In particular, although a steel foil which is as thin as 0.05 millimeters ensures a smaller gap between adjacent false bars, the use of the 0.05 millimeters thick steel foil increases the manufacturing costs, and lowers strength of the mask.

Figure 6:
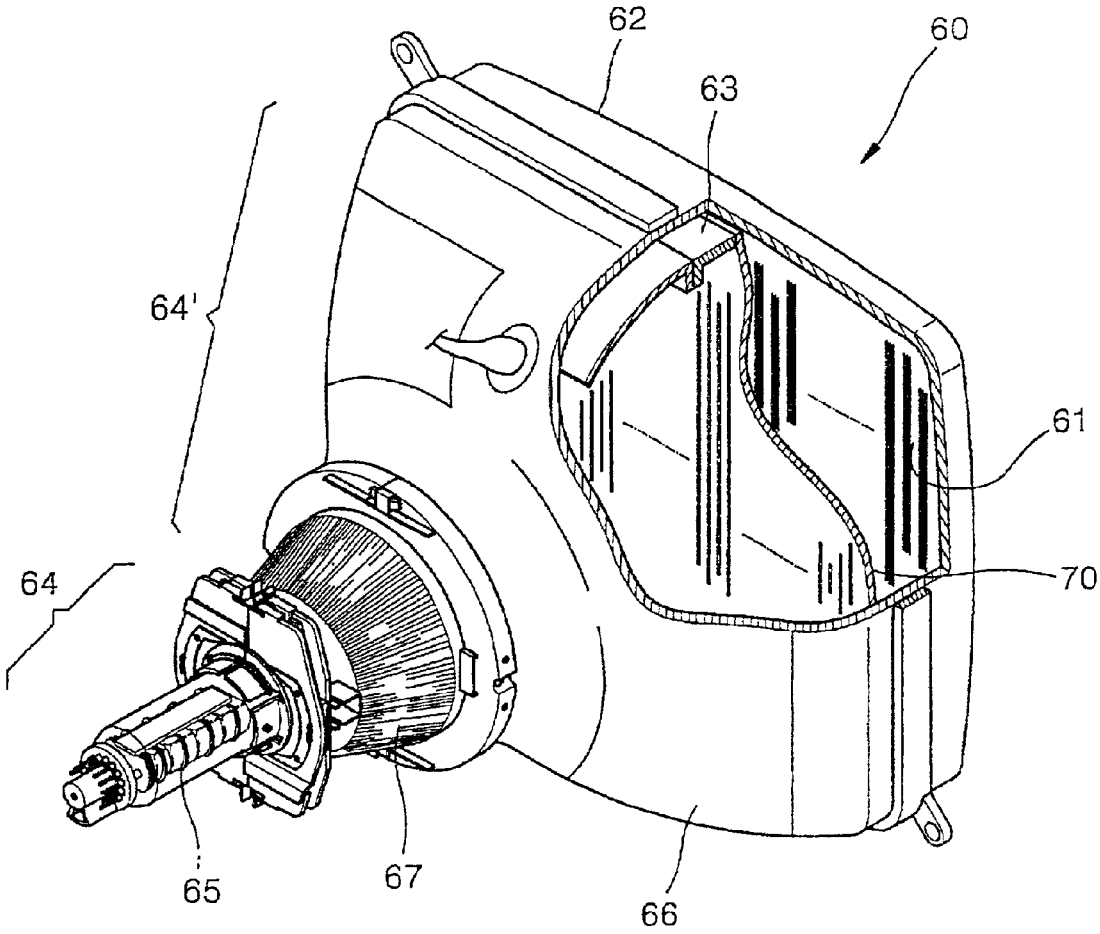
FIG. 6 is an exploded perspective view of a cathode-ray tube into which a preferred embodiment of a tension mask according to the present invention is secured.

A cathode-ray tube (CRT), into which a preferred embodiment of a tension mask according to the present invention is secured, is shown in FIG. 6. As shown in FIG. 6, a cathode-ray tube 60 includes a panel 62 having on the inner side thereof a phosphor screen 61 with a predetermined pattern, a tension mask 70 installed on the inner side of the panel 62, which allows three electron beams emitted from an electron gun 65 to land onto each phosphor deposited on the phosphor screen 61, and a frame 63 secured into the panel 62 to support the tension mask 70. The panel 62 is connected with a funnel 66 having a neck portion 64 and a cone portion 64', where the electron gun 65 is inserted in the neck portion 64, and a deflection yoke 67 for deflecting electron beams emitted from the electron gun 65, such that the electron beams accurately land on each phosphor of the phosphor screen 61, is installed over the neck portion 64 and the cone portion 64'.

Figure 7:
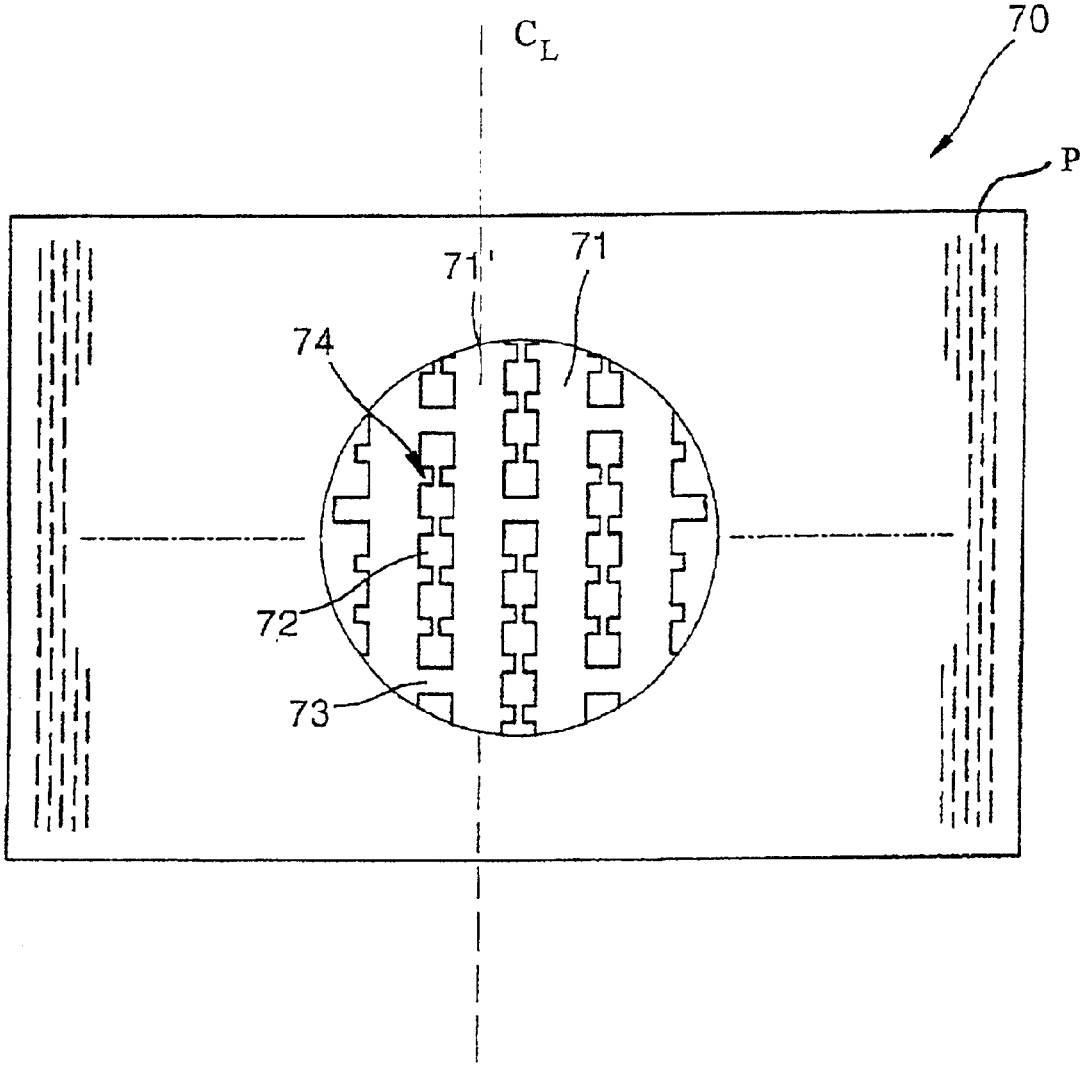
FIG. 7 is a plan view of the tension mask of FIG. 6.
Figure 8:
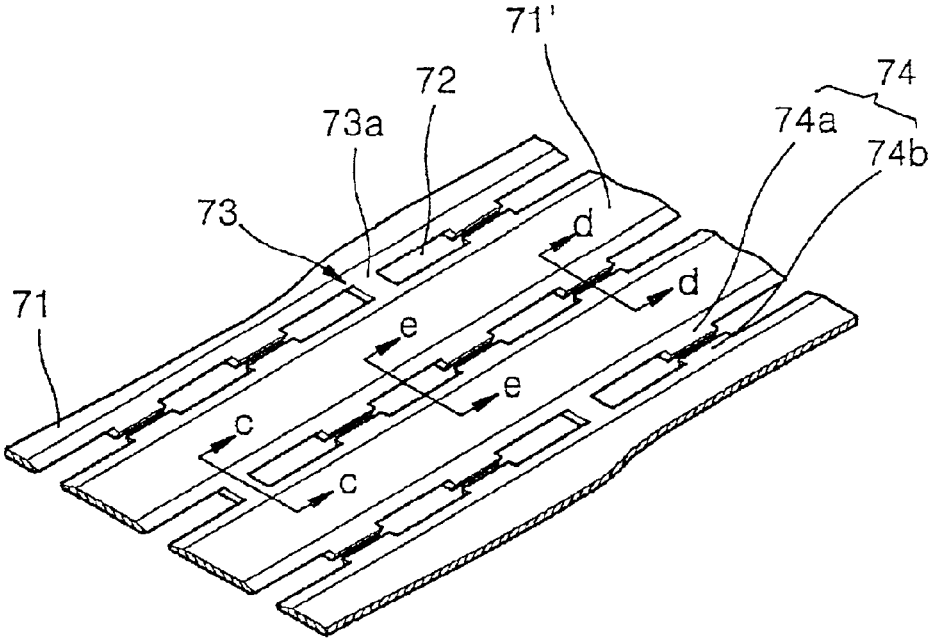
FIG. 8 is an enlarged perspective view of the tension mask shown in FIG. 7.
Figure 9:
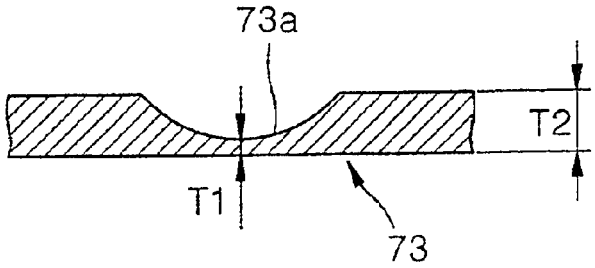
FIG. 9 is a sectional view taken along line c—c of FIG. 8.

The tension mask 70, which allows three electron beams to accurately land on the phosphor screen 61 in the cathode-ray tube, is shown in greater detail in FIGS. 7 and 8. The tension mask 70, which is formed of a steel foil, includes a series of parallel strips 71 and 71' separated from each other by a predetermined distance, and a plurality of real bridges 73 intersecting adjacent strips 71 and 71', forming slots 72 through which electron beams pass. As shown in FIG. 9, each of the real bridges 73 may have a recession 73*a* with a predetermined depth. The thickness T1 at the center of the real bridge 73 is smaller than the thickness T2 of the strip 71.

Figure 10:
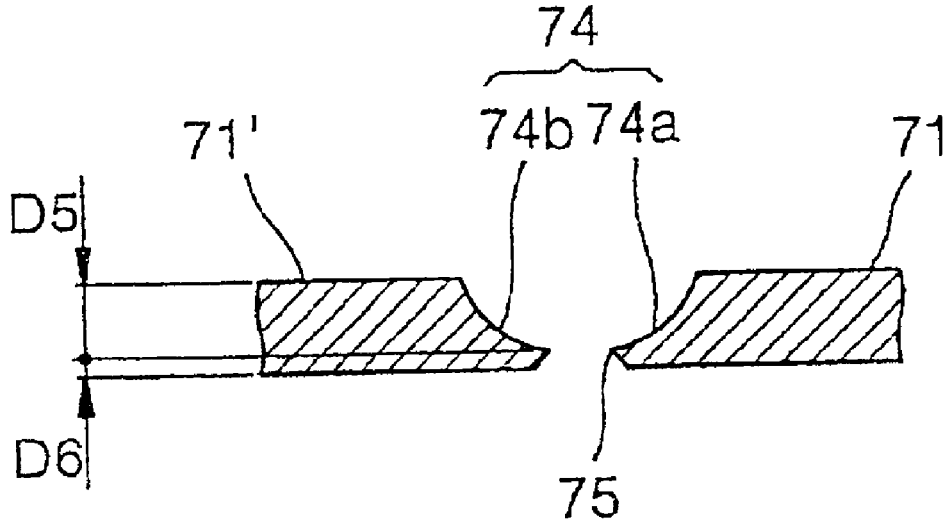
FIG. 10 is a sectional view taken along line d—d of FIG. 8.

As shown in FIG. 10, a plurality of dummy bridges 74, which are a plurality of projections 74*a* and 74*b* partially extending between but not intersecting the adjacent strips 71 and 71', are disposed in the slots 72. An etching boundary 75 at the end of each of the projections 74*a* and 74*b*, where etchings from the top and bottom of the strips 71 and 71' stop, is located close to the bottom of the strips 71 and 71'. In other words, the distance D5 from the top of the strips 71 and 71' to the etching boundary 75 is larger than the distance D6 from the bottom of the strips 71 and 71' to the etching boundary 75. The distance D6 is preferably 0.25 or more times smaller than the thickness of the strips 71 and 71'. It is preferable that the distance D6 from the bottom of the strips 71 and 71' to the etching boundary 75 of the dummy bridge 74 is substantially the same as the thickness T1 at the center of the real bridge 73 having the recession 73*a*.

Figure 11A:
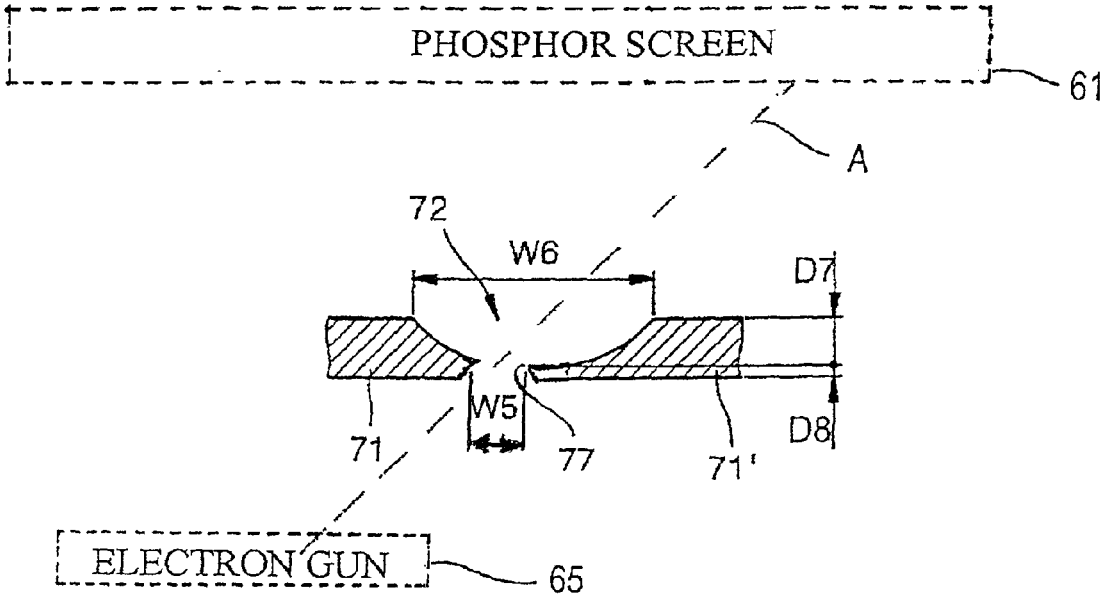
FIGS. 11A and 11B are sectional views taken along line e—e of FIG. 8.
Figure 11B:
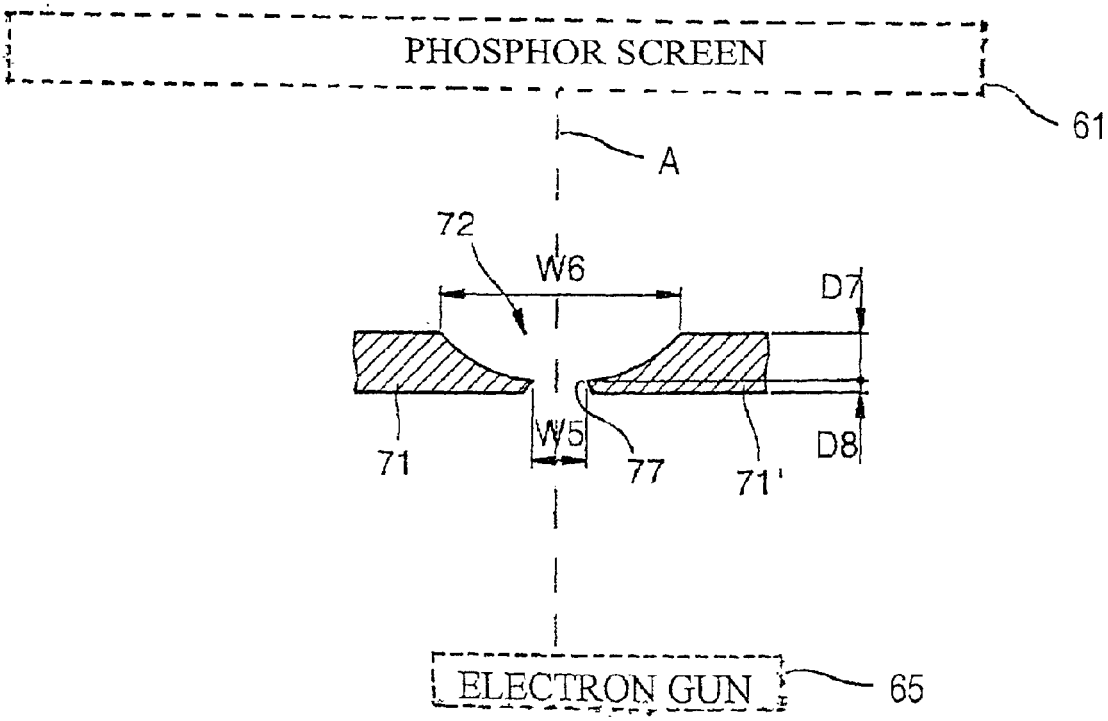

In the tension mask having the above pattern, as shown in FIG. 11A, the width of a slot 72 adjacent to the strips 71 and 71', which has no dummy bridges 74, is different at the beam entering and emitting sides. In particular, the width W5 of the slot 72 at the beam entering side is narrower than the width W6 of the slot 72 at the beam emitting side. Etching boundaries 77 of the adjacent strips 71 and 71' are approximately located in the middle of the strips 71 and 71'. The distance D7 from the top of the strip 71 or 71' to the etching boundary 77 may be larger than the distance D8 from the bottom of the strip 71 or 71' to the etching boundary 77. It is preferable that the relative position of the beam entering side of the slot 72 having the width W5 is shifted or extended toward the center of the tension mask in relation to the beam emitting side of the slot 72 having width W6 as the location of the slot 72 comes closer to the periphery of the tension mask as seen in FIGS. 11A and 11B. In FIG. 11A the slot 72 is located toward the periphery of the tension mask. The width W5 is shifted more toward the center of the tension mask as seen by the electron gun 65 emits the electron beam A through the slot 72 to the phosphor screen 61. In FIG. 11B, the slot is located toward the center of the tension mask. The width W5 is located in the center portion with respect to the width W6, allowing the beam A from the electron gun 65 to pass through the slot 72. The beam emitting side portion of the slot 72 having width W6 is etched, and the beam entering side portion of the slot 72 is etched away from the center of the beam emitting side portion W6 and toward the center of the tension mask as the slot 72 is formed toward the periphery of the tension mask. The etching on the beam emitting side having width W6 and the etching on the beam entering side of the tension mask having the width W5 creates the slot 72. The slot 72 allows the electron beam A to pass through to the phosphor screen 61. The center of the tension mask can be defined as the center line CL as seen in FIG. 7. As the slots 72 are located toward the periphery P, the width W5 is shifted more toward the center line CL of the tension mask 70 with respect to width W6 of the slot 72. The shift of the width W5, reduces the clipping of the electron beams.

The area of the dummy bridges 74 can be varied. For example, the sum of the areas of the adjacent dummy bridges, i.e., the projections 74*a* and 74*b*, may be progressively increased or decreased toward the periphery of the tension mask. In addition, the relative position of the gap between the projections 74*a* and 74*b* can be increasingly shifted as proximity to the periphery of the tension mask increases, so that the degree of clipping of electron beam decreases.

Figure 12:
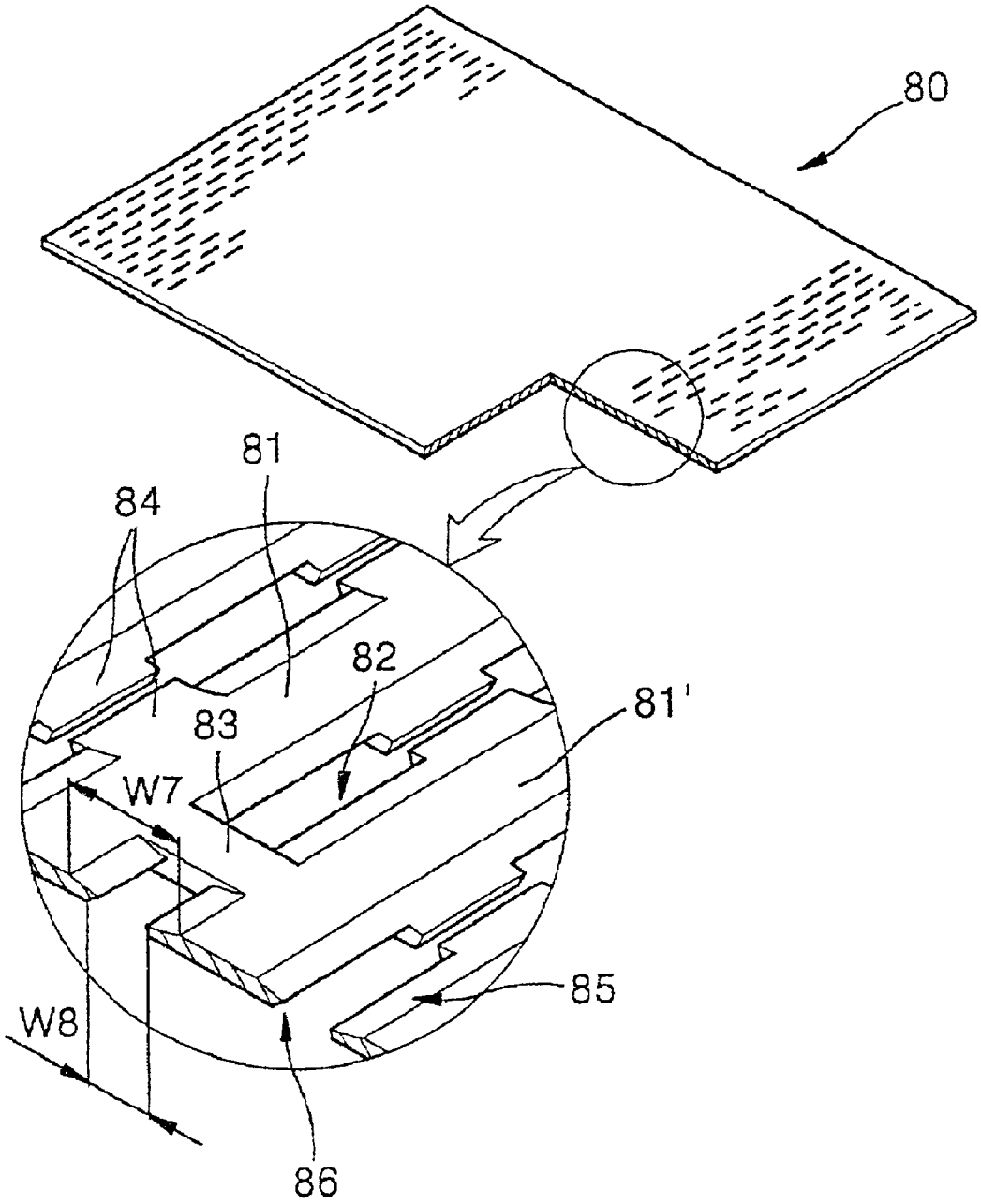
FIG. 12 is a perspective view of another embodiment of the tension mask according to the present invention.

Another embodiment of the tension mask according to the present invention is shown in FIG. 12. As shown in FIG. 12, the tension mask 80 includes a series of parallel strips 81 and 81' separated from each other by a predetermined distance, a plurality of real bridges 83 intersecting the adjacent strips 81 and 81' to form slots 82 through which electron beams pass, and a plurality of dummy bridges 84 located in the slots 82, which partially extend between but not intersecting the adjacent strips 81 and 81'. A first rounded (or curved) portion 85 with a first width W7 is formed at the light emitting side of the slot 82 along the edges of the adjacent strips 81 and 81', and a second rounded portion 86 with a second width W8, which is smaller than the first width W7, is formed at the light entering side of the slot 82.

Due to the presence of the first rounded portion 85 with the first width W7 at the beam emitting side of the slot 82, the real bridges 83 can be formed to be planar, rather than to have the recession 73*a* as in the embodiment described with reference to FIG. 8. The shapes of the adjacent strips 81 and 81' and of the facing dummy bridges 84 at the edges thereof are the same as those of the strips 71 and 71' and the dummy bridges 74, and thus descriptions thereof will not provided here.

As previously described, in the tension masks according to the present invention, the distance from the top of the strips to the etching boundaries of the dummy bridges is larger than the distance from the bottom of the strips thereto, and thus the gap between the etching boundaries of the facing dummy bridges can be reduced without causing clogging of the gap in etching the strips of the tension mask. As a result, the amount of electron beams passing through the gaps of the adjacent dummy bridges decreases, so that a reflection image of the dummy bridges is not shown on the screen.

In addition, the width of each slot at the beam emitting side is wider than at the beam entering side, and the relative position of the slot at the beam entering side with respect to the beam emitting side is shifted toward the center of the tension mask. The real bridges are designed to have a recession, or the edges of the adjacent strips are designed to have rounded portions, so that clipping of electron beams passing through slots can be reduced. In particular, as electron beams emitted from the electron gun 65 (see FIG. 6) land onto the phosphor screen 61 through slots of the tension mask 70 after having been deflected by the deflection yoke 67, the amount of electron beams passing through the slots of the tension mask 70 increases at the center of the tension mask 70. This is because the edge boundaries of the adjacent strips are located in the middle of the strips, facing each other, thereby resulting in a maximum gap between the adjacent strips. Another reason is that each slot at the beam entering side is shifted with respect to the beam emitting side toward the center of the tension mask. As a result, the degree of clipping of electron beams decreases compared with a conventional tension mask.

Figure 13:
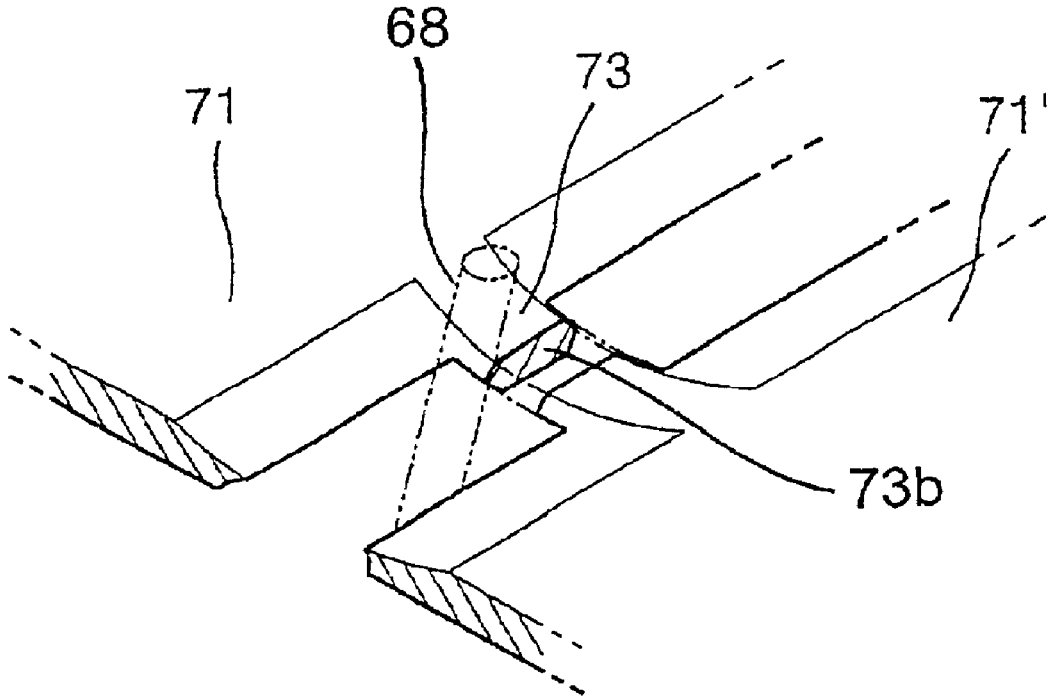
FIG. 13 is a perspective view illustrating passing of an electron beam through a slot of the tension mask according to the present invention.

Furthermore, as for the tension mask described with reference to FIG. 8, because the recession 73*a* with the thickness of T1 is formed at the top surface of each of the real bridges 73, a cross-sectional area 73*b* of the real bridge 73 decreases, thereby reducing clipping of electron beams 68 in a vertical direction, as shown in FIG. 13.

Figure 14:
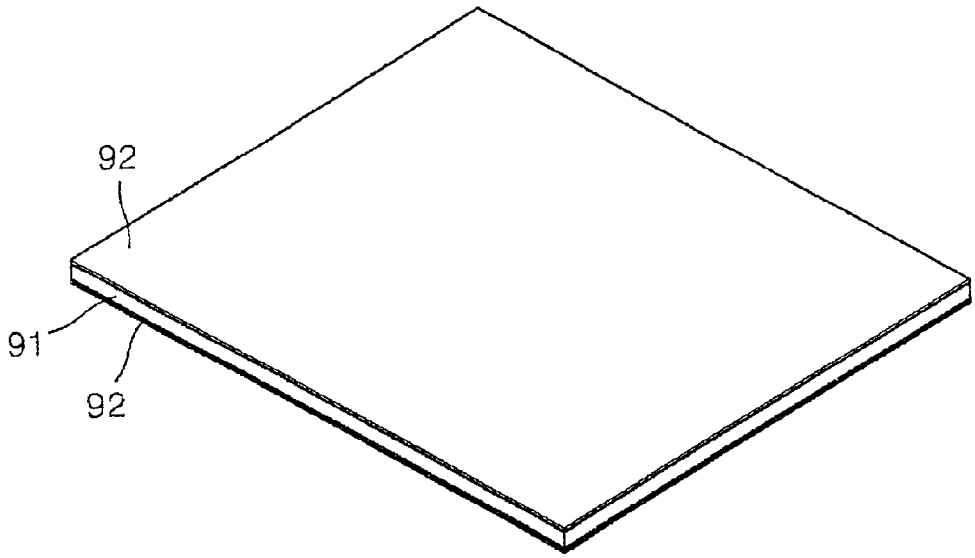
FIGS. 14 through 19 illustrate a method for manufacturing a tension mask according to the present invention.
Figure 15:
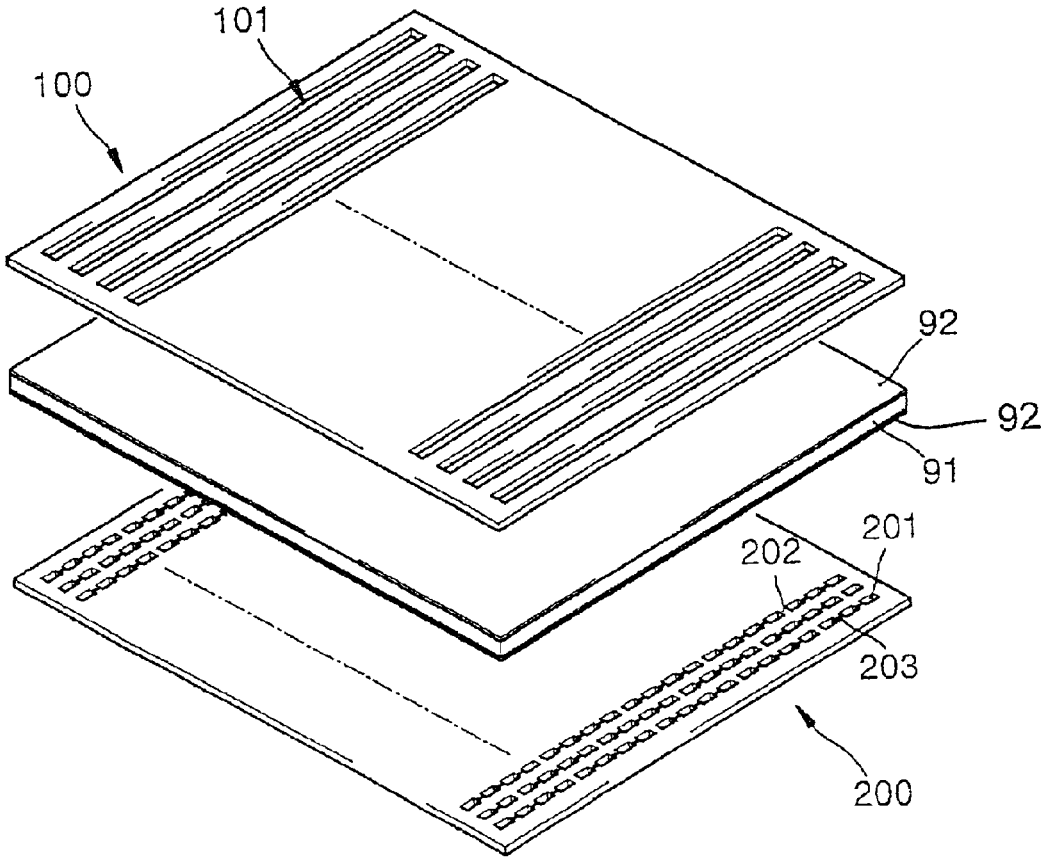

A method for manufacturing a tension mask having such a pattern described above, and an embodiment of an exposure mask for use in the manufacture of the tension mask will be described with reference to FIGS. 14 through 19. Referring to FIG. 14, a steel foil 91 is prepared and photosensitive layers 92 are coated on the top and bottom surfaces of the steel foil 91. When the coating of the photosensitive layers 92 is completed, an upper exposure mask 100 and a lower exposure mask 200 are aligned over the top and bottom surfaces of the steel foil 91, respectively, as shown in FIG. 15.

Figure 16:
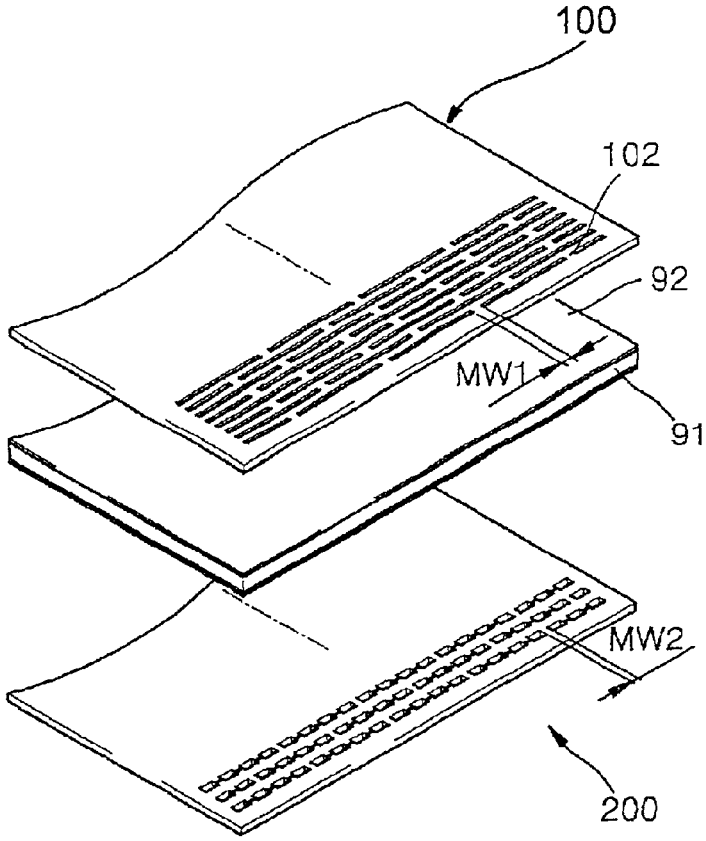

The upper exposure mask 100 has a pattern including a series of parallel upper light transmission portions 101, which are slits arranged in lines. The width of each upper light transmission portion 101 is large enough to expose slots and a pair of first rounded portions of a desired tension mask. Preferably, the width of each of the upper light transmitting portions 101 is approximately two times the width of each slot of the tension mask. As shown in FIG. 16, the upper exposure mask 100 may have a plurality of upper light shielding portions 102 for real bridges of the tension mask, which intersect the upper light transmission portions 101, corresponding to a plurality of lower first light shielding portions 202 of the lower exposure mask 100 described below.

The lower exposure mask 200 has a pattern including a series of parallel lower light transmission portions 201, which are slits arranged in lines, a plurality of lower first light shielding portions 202 for real bridges, which intersect each of the lower light transmission portions 201, and a plurality of lower second light shielding portions 203, which partially extend between the edges of the lower light transmission portions 201. The width MW2 of the lower first light shielding portions 202 is wider than the width MW1 of the upper light shielding portions 102.

Figure 17:
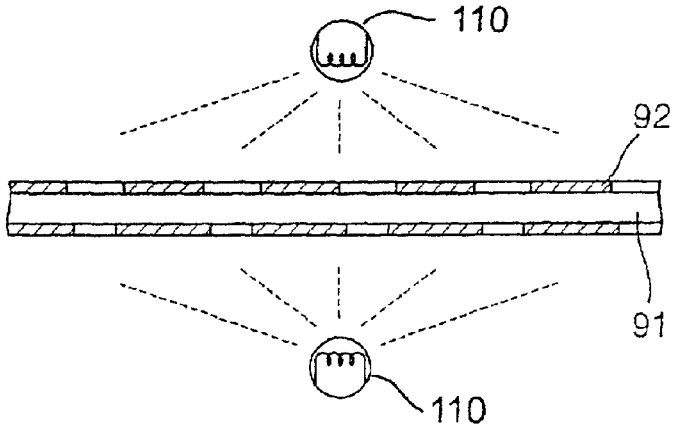

When the upper and lower exposure masks 100 and 200 are arranged over the top and bottom surfaces of the steel foil 91, as shown in FIG. 17, the photosensitive layers 92 coated on the steel foil 91, which are uncovered with the upper and lower exposure mask 100 and 200, are exposed to an exposure light source 110. During the exposure process, the photosensitive layers 92 are uniformly irradiated with the exposure light source 110.

Figure 18:
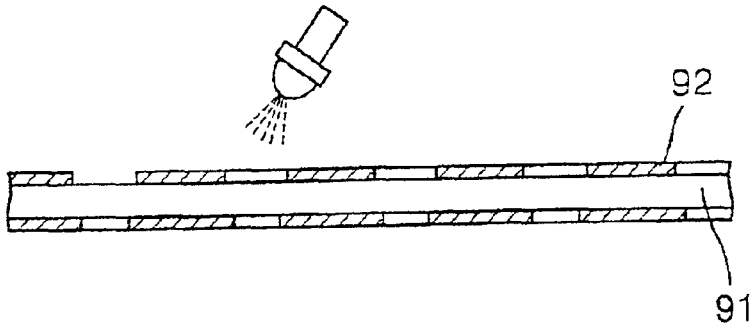
Figure 19:
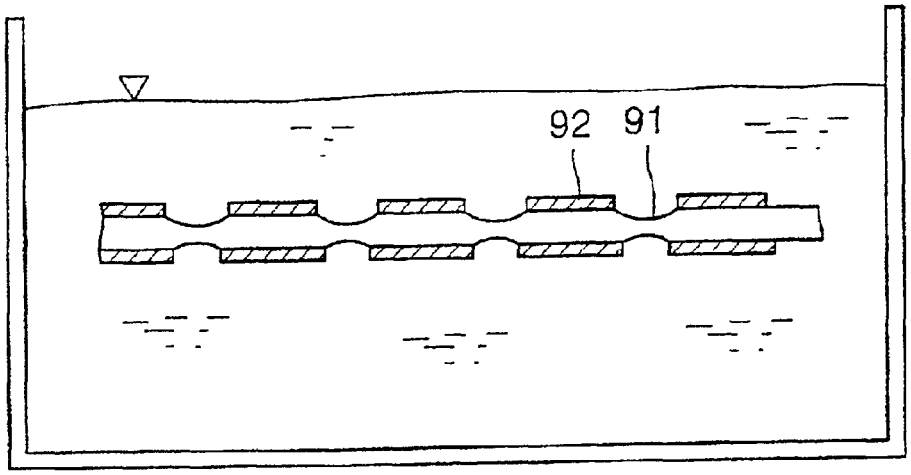

When exposing the photosensitive layers 92 is completed, the upper and lower exposure masks 100 and 200 are removed from the top and bottom surfaces of the steel foil 91, respectively, the resultant structure is developed using a developing solution, as shown in FIG. 18. Referring to FIG. 19, after the developing process, the steel foil 91 with the photosensitive layers 92 is etched in an etchant, and washed, thereby resulting in a complete tension mask.

As described previously, the exposure mask used in the manufacture of the tension mask according to the present invention has a simple pattern. That is, it is unnecessary to form the light shielding portions for both real bridges and dummy bridges, which was included in an earlier exposure mask, in both the upper and lower exposure masks. In addition, the gap between the facing dummy bridges of the inventive tension mask is narrower than that of an earlier tension mask, while the area of the cross-section of a single dummy bridge remains rigid.

As previously mentioned, in the tension mask and the method for manufacturing the tension mask with the inventive exposure mask including a fine pattern, the inventive tension mask has fine slots and real and dummy bridges, so that reflection images of the bridges are not seen when the tension mask is secured into a cathode-ray tube. In addition, the work time required for manufacturing the tension mask decreases due to use of the simple exposure mask, thereby improving the productivity of tension mask.

While this invention has been particularly shown and described with reference to preferred embodiments thereof, it will be understood by those skilled in the art that various changes in form and details may be made to the described embodiments without departing from the spirit and scope of the invention as defined by the appended claims.

What is claimed is:

1. A tension mask for a color cathode-ray tube, comprising:

a plurality of parallel strips separated by a predetermined distance from each other;

a plurality of real bridges intersecting adjacent strips among said plurality of parallel strips to define slots, the slots accommodating electron beams to pass through; and a plurality of dummy bridges located in the slots, partially extending between but not intersecting the adjacent strips, said plurality of dummy bridges having projections facing each other without touching, said dummy bridges having an etching boundary located below the middle of said strips.

2. The tension mask of claim 1, with said plurality of real bridges being recessed by a predetermined depth from the top surface of said real bridges, and the thickness of each of said real bridges being smaller at the center than at the periphery of said real bridges.

3. The tension mask of claim 2, with the thickness of each of one said real bridges at the recessed center of the real bridges being approximately the same as the distance from the bottom of the strips to said etching boundaries of said dummy bridges.

4. The tension mask of claim 1, with each of said plurality of real bridges having a planar top surface.

5. The tension mask of claim 4, with the top or bottom surface of said real bridges being at the same level as the surfaces of said adjacent strips.

6. The tension mask of claim 1, with the distance from the bottom of said strips to the etching boundaries of said dummy bridges being 0.25 times smaller than the thickness of said strips.

7. The tension mask of claim 6, with the thickness of each of said real bridges at the recessed center of said real bridges being approximately the same as the distance from the bottom of said strips to the etching boundaries of said dummy bridges.

8. The tension mask of claim 1, with the distance from the top of the strips to the etching boundaries of said dummy bridges being larger than the distance from the bottom of the strips to the etching boundaries of said dummy bridges, the top of the strips being on the electron beam emitting side and the bottom of the strips being on the electron beam entering side.

9. The tension mask of claim 1, with the relative position of each of the slots at the beam entering side with respect to the beam emitting side of said tension mask being shifted toward the center of said tension mask as the locations of the slots become closer to the periphery of said tension mask.

10. The tension mask of claim 9, with the relative position of each of the slots at the beam entering side being shifted toward the center of said tension mask by etching a portion of each slot on the beam emitting side with a predetermined width, and shifting an etch of a portion of each slot on the beam emitting side with a predetermined width towards the center of said tension mask with respect to the etch of the portion of the slot on the beam emitting side, the etch on the beam emitting side and the etch on the beam entering side forming one of the slots of said tension mask.

11. The tension mask of claim 9, with the center of said tension mask being a center line accross a width of said tension mask.

12. The tension mask of claim 1, with the relative position of the gap between the facing dummy bridges being shifted toward the center or the periphery of said tension mask as the locations of said dummy bridges become closer to the periphery of said tension mask.

13. The tension mask of claim 12, with the relative position of the gap between the facing dummy bridges being shifted toward the center or the periphery of said tension mask according to the reduction of the clipping of the electron beams.

14. The tension mask of claim 1, with the width of each of said dummy bridges along said strips becoming narrow as the locations of said dummy bridges come closer to the periphery of said tension mask.

15. The tension mask of claim 12, with the width of each of said dummy bridges along said strips becoming narrow as the locations of said dummy bridges come closer to the periphery of said tension mask.

16. The tension mask of claim 1, with the area of each of the dummy bridges becoming smaller as the locations of the dummy bridges come closer to the periphery of the tension mask.

17. The tension mask of claim 1, with said adjacent strips having rounded portions to reduce the clipping of electron beams.

18. The tension mask of claim 1, with the width of each of the slots at the electron beam emitting side being wider than at the electron beam entering side.

19. The tension mask of claim 1, being manufactured by an exposure mask comprising a pair of upper and lower exposure masks to be aligned over the top and bottom surfaces of a steel foil, respectively, to accommodate exposure of photosensitive layers deposited on said steel foil, said upper exposure mask having a pattern including a series of parallel upper light transmission portions arranged in lines, said lower exposure mask comprising:

a pattern including a series of parallel lower light transmission portions arranged in lines;

a plurality of first light shielding portions intersecting adjacent lower light transmission portions among said series of parallel lower light transmission portions; and a plurality of second light shielding portions partially extending between the adjacent lower light transmission portions.

20. A tension mask for a color cathode-ray tube, comprising:

a plurality of parallel strips separated by a predetermined distance from each other;

a plurality of real bridges intersecting adjacent strips among said plurality of parallel strips to define slots accommodating electron beams to pass through;

a plurality of dummy bridges located in the slots, partially extending between but not intersecting the adjacent strips, said dummy bridges facing each other, an etching boundary of each of said dummy bridges being located below the middle of said strips;

a pair of first rounded portions formed with a first thickness at the beam emitting side of each of the slots, partially extending from the adjacent strips; and a pair of second rounded portions formed with a second width at the beam entering side of each of the slots, partially extending from the adjacent strips.

21. The tension mask of claim 20, with the relative position of each of the slots at the beam entering side with respect to the beam emitting side being shifted toward the center of the tension mask as the locations of the slots come closer to the periphery of the tension mask.

22. The tension mask of claim 20, with the relative position of the gap between the facing dummy bridges being shifted toward the center or the periphery of said tension mask as the locations of said dummy bridges come closer to the periphery of said tension mask.

23. The tension mask of claim 20, with said plurality of real bridges being recessed by a predetermined depth from the top surface of said real bridges, and the thickness of each of said real bridges being smaller at the center than at the periphery of said real bridges.

24. The tension mask of claim 20, with each of said plurality of real bridges having a planar top surface.

* * * * *